US008684484B2

(12) United States Patent
Satake

(10) Patent No.: US 8,684,484 B2
(45) Date of Patent: Apr. 1, 2014

(54) IMAGE FORMING METHOD, IMAGE FORMING APPARATUS AND INKJET HEAD

(75) Inventor: Kenichi Satake, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 13/465,473

(22) Filed: May 7, 2012

(65) Prior Publication Data

US 2012/0274690 A1 Nov. 1, 2012

Related U.S. Application Data

(62) Division of application No. 12/407,546, filed on Mar. 19, 2009, now Pat. No. 8,197,020.

(30) Foreign Application Priority Data

Apr. 23, 2008 (JP) ..... 2008-112413

(51) Int. Cl.
*B41J 29/38* (2006.01)

(52) U.S. Cl.
USPC ..... 347/10; 347/11; 347/9

(58) Field of Classification Search
USPC ..... 347/5, 9, 10, 11, 12
See application file for complete search history.

(56) References Cited

U.S. PATENT DOCUMENTS 6,099,103 A * 8/2000 Takahashi ..... 347/11
6,494,555 B1 * 12/2002 Ishikawa ..... 347/10
6,851,780 B2 * 2/2005 Fujimura et al. ..... 347/11

* cited by examiner

*Primary Examiner* — Lam S Nguyen
(74) *Attorney, Agent, or Firm* — Dykema Gossett PLLC

(57) ABSTRACT

An image forming method for use in an inkjet head includes a pressure chamber filled with ink, a nozzle which communicates with the pressure chamber and in which a meniscus of the ink is formed, a piezoelectric element which pressurizes the pressure chamber, and a drive circuit which performs an operation of ejecting the ink in a printing state and generates a basic pulse for vibrating the meniscus in a non-printing state. The basic pulse is generated by turning off a voltage applied to the piezoelectric element for substantially the same period as a natural vibration period of the ink. An additional pulse is generated at least once before or after the basic pulse when the basic pulse is generated by the drive circuit in the non-printing state. The additional pulse is generated by turning off the voltage applied to the piezoelectric element.

15 Claims, 13 Drawing Sheets

IMAGE FORMING METHOD, IMAGE FORMING APPARATUS AND INKJET HEAD

CROSS-REFERENCE TO RELATED APPLICATIONS

This application is a divisional of U.S. patent application Ser. No. 12/407,546, filed Mar. 19, 2009 now U.S. Pat. No. 8,197,020, the entire contents of which are incorporated herein by reference, which claims priority to Japanese Patent application no. 2008-112413, filed Apr. 23, 2008, the entire contents of which are incorporated herein by reference.

BACKGROUND OF THE INVENTION a. Field of the Invention

The present invention relates to image forming methods, image forming apparatuses and an inkjet head and, more particularly, to an inkjet image forming apparatus, such as a printer, a copy machine, a facsimile machine, or a multi-function peripheral having the functions thereof, and an image forming method used in the image forming apparatus.

b. Description of the Background Art

As shown in, for example, FIGS. 2 and 3, an image forming apparatus, such as an on-demand inkjet printer, employs an inkjet head including a pressure chamber 2 filled with ink. The pressure chamber 2 is connected to a nozzle 3. When the pressure chamber 2 is filled with ink, an ink meniscus (hereinafter referred to simply as "meniscus") is formed in the nozzle 3. The meniscus is a boundary between liquid contained in a thin pipe or the like and surrounding gas, and generally means a surface of the liquid. A piezoelectric element 9 which deforms when a drive voltage is applied thereto and a vibrating plate 7 which is laminated together with the piezoelectric element 9 are provided on the pressure chamber 2 on a side opposite the nozzle 3. The piezoelectric element 9 and the vibrating plate 7 form a driving unit D.

In the inkjet head, the driving unit D transmits a force generated as a result of deformation of the piezoelectric element 9 to the ink contained in the pressure chamber 2 as pressure. Thus, the driving unit D serves as a drive source for ejecting an ink droplet from the nozzle 3 connected to the pressure chamber 2. More specifically, the driving unit D deforms the piezoelectric element 9 by applying a drive voltage thereto, so that the vibrating plate 7 bends toward the pressure chamber 2, as shown by the dot-dash lines in FIG. 2. Accordingly, the capacity of the pressure chamber 2 is reduced and the ink contained in the pressure chamber 2 is pressurized. As a result, the ink is ejected from an end of the nozzle 3 as an ink droplet. The vibrating plate 7 also bends in a direction opposite to the direction shown by the dot-dash lines in FIG. 2 when the vibrating plate 7 receives pressure from the ink contained in the pressure chamber 2. Thus, the driving unit D also serves as an elastic element with respect to the vibration of the ink.

When a voltage is applied to the piezoelectric element 9 and stress is generated, the ink receives a pressure from the driving unit D through the vibrating plate 7 and starts to vibrate. In the vibration of the ink, the driving unit D and the pressure chamber 2 serve as elastic elements. A supply hole 5 through which the ink is supplied to the pressure chamber 2, an ink channel 4 which connects the pressure chamber 2 to the nozzle 3, and the nozzle 3 serve as inertial elements. The natural vibration period of the volume velocity of the ink in each of the above-mentioned sections is determined by the dimensions of each section, the physical properties of the ink, and the dimensions and physical properties of the driving unit D. In the piezoelectric inkjet head, the vibration of the ink is generated so that the meniscus in the nozzle 3 also vibrates, and thereby the ink droplet is ejected.

In the inkjet head having the above-described structure, a constant drive voltage is continuously applied to the piezoelectric element 9 in a non-printing state so that the piezoelectric element 9 is continuously deformed and the vibrating plate 7 is continuously bent. Thus, the state in which the capacity of the pressure chamber 2 is reduced is maintained. In a printing operation, the following driving method is generally used. First, the drive voltage is reduced to 0 so that the deformation of the piezoelectric element 9 and the bending of the vibrating plate 7 are canceled immediately before printing is started. Accordingly, the capacity of the pressure chamber 2 increases and the ink meniscus in the nozzle 3 is temporarily pulled toward the pressure chamber 2. Second, the drive voltage is applied to the piezoelectric element 9 again so that the piezoelectric element 9 is deformed and the vibrating plate 7 is bent toward the pressure chamber 2. Accordingly, the capacity of the pressure chamber 2 decreases and the ink droplet is ejected from the end of the nozzle 3. This driving method will sometimes be referred to as "the pull-push driving method" in the following description.

FIG. 12 is a schematic graph illustrating the relationship between the fluctuating voltage wave of the drive voltage Vp (shown by the dot-dash curve) applied to the piezoelectric element 9 in the above-described pull-push driving method and the variation in the volume velocity of the ink (shown by the solid curve L) in the nozzle 3 when the fluctuating voltage wave is applied. The fluctuating voltage is the voltage measured between an electric power source (not shown) and the piezoelectric element 9. With regard to the volume velocity of the ink, the positive sign shows the direction toward the end of the nozzle 3 and the negative sign shows the direction toward the pressure chamber 2. Here, a case is considered in which the thin, plate-shaped or layered piezoelectric element 9 shown in FIGS. 2 and 3 is used. When a fluctuating voltage is applied, the piezoelectric element 9 vibrates in a transverse vibration mode in which the piezoelectric element 9 expands and contracts in a planar direction.

The fluctuating method will be described with reference to FIG. 12. In a standby state before time 0 at the left end in FIG. 12, the drive voltage Vp is maintained at VH (Vp=VH) so that the piezoelectric element 9 is continuously contracted in the planar direction. Therefore, the vibrating plate 7 is continuously bent in a certain shape so that the state in which the capacity of the pressure chamber 2 is reduced is maintained. Before time 0, the ink is in the stationary state. In other words, the volume velocity of the ink in the nozzle 3 (line C) is maintained at 0 and the meniscus in the nozzle 3 is stationary.

The following procedure is taken in order to eject an ink droplet from the nozzle 3 toward a sheet of paper. Firstly, the drive voltage Vp applied to the piezoelectric element 9 at time 0 is reduced to 0 (Vp=0). Accordingly, the piezoelectric element 9 is released from the state in which the piezoelectric element 9 is contracted in the planar direction and the vibrating plate 7 is released from the bent state. As a result, the capacity of the pressure chamber 2 increases by a predetermined amount and the meniscus of the ink in the nozzle 3 is pulled toward the pressure chamber 2 by a distance corresponding to the amount of increase in the capacity of the pressure chamber 2. In this process, the volume velocity of the ink in the nozzle 3 temporarily increases in the negative direction, as shown by the curve L in FIG. 12, and then gradually decreases and approaches 0 (time P1). This time period corresponds to substantially half of the natural vibration period of the ink.

Secondly, when the volume velocity of the ink in the nozzle 3 is substantially equal to 0 (time P1), the drive voltage Vp is increased to VH again (Vp=VH) so that the piezoelectric element 9 is contracted in the planar direction and the vibrating plate 7 is bent. As is clear from the curve Vp, the above-described operation corresponds to an operation in which the drive voltage Vp is applied to the piezoelectric element 9 in the form of a drive-voltage pulse wave having a pulse width of about ½ of the natural vibration period of the ink.

Accordingly, the vibrating plate 7 is bent and the capacity of the pressure chamber 2 is reduced at the time when the meniscus of the ink in the nozzle 3 is about to return to the end of the nozzle 3 after being maximally pulled toward the pressure chamber 2 and being set to a stationary state (i.e., a state in which the volume velocity is 0). Therefore, the ink in the nozzle 3 receives the pressure of ink pushed out of the pressure chamber 2 and is accelerated toward the end of the nozzle 3. As a result, the ink largely projects outward from the end of the nozzle 3 (time P2). The volume velocity of the ink in the nozzle 3 temporarily increases in the positive direction, as shown by the curve L in FIG. 12, and then gradually decreases and approaches 0 (time P3). The ink which projects outward from the end of the nozzle 3 has a substantially columnar shape. Therefore, the ink in this state is generally called an ink column. After the volume velocity of the ink in the nozzle 3 reaches 0, the direction of the pressure wave of the ink changes to the direction toward the pressure chamber 2. Therefore, the ink column, which maximally projects outward from the end of the nozzle 3, is separated from the ink in the nozzle 3, and is ejected as an ink droplet. The ejected ink droplet is caused to land on a sheet of paper.

As shown in FIG. 1, for example, in an actual inkjet head, a plurality of printing units, each of which includes the pressure chamber 2, the nozzle 3, the piezoelectric element 9 and the vibrating plate 7, etc. as above-mentioned, are generally formed on a single substrate 1. The printing units are selectively operated at a predetermined driving frequency in accordance with data corresponding to an image to be formed, so that ink droplets are selectively ejected from the nozzles 3 in the printing units to form dots on a sheet of paper. This operation is repeated to form the image on the sheet of paper. Therefore, operation intervals of the printing units are not uniform. For example, some printing units may be operated every driving cycle, and other printing units may be operated after being at rest for a relatively long time after being operated once.

In the pull-push driving method, the above-described standby state (i.e., the state in which a constant drive voltage is applied to the piezoelectric element 9 so that the capacity of the pressure chamber 2 is reduced) is continuously set for each of the printing units other than the printing units to be operated. Accordingly, in each of the printing units other than the printing units to be operated, the ink is prevented from being ejected from the end of the nozzle 3 as an ink droplet. In the standby state, the ink and the meniscus are stationary. If the standby state is set for a long time, components such as the solvent included in the ink evaporate and the viscosity of the ink increases in an area near the ink meniscus, which is the boundary between the ink and the surrounding air. As a result, it becomes difficult to reliably eject the ink droplets. In addition, there is a risk that the nozzles 3 will be clogged and, therefore, that the ink cannot be ejected from the nozzles 3. This problem is particularly severe in the case where ink containing a highly volatile solvent is used to improve the drying performance of the dots formed on the sheet.

To prevent the viscosity of the ink from being increased or to cancel the increase in viscosity if the viscosity is increased, a technique has been proposed in which a small fluctuating voltage is applied to the piezoelectric element 9 in a standby state. As a result, the vibrating plate 7 slightly vibrates without causing the ink to be ejected, thereby stirring the ink in the pressure chamber 2.

In addition, the inventor of the present invention has proposed a preferable technique in which a basic pulse with substantially the same period as the natural vibration period of the ink is generated and a fluctuating voltage based on the basic pulse is applied to the piezoelectric element 9.

The inventor of the present invention has disclosed a basic pulse preferable for vibrating the meniscus without causing the ink droplet to be ejected from the nozzle 3.

SUMMARY OF THE INVENTION

Even when the above-mentioned basic pulse is used, however, there is a slight possibility that the ink droplet will be ejected from the nozzle 3 depending on the conditions, such as viscosity of the ink and room temperature. Unless this problem is solved, there is a risk that the ink will be ejected in the non-printing state and the inside of the image forming apparatus will be stained. In addition, there is also a risk that the ink droplets will be ejected toward a non-printing area of the sheet and the image quality will be degraded.

In light of the above-described situation, an object of the present invention is to provide an image forming method an image forming apparatus and an inkjet head capable of vibrating the meniscus without causing the ink droplet to be ejected from the nozzle.

To achieve the above-described object, the present invention employs the following means.

The inventors of the present invention have found through computer simulation that the meniscus can be vibrated without causing the ink droplet to be ejected from the nozzle if an additional pulse having substantially the same period as a rising period of the above-described basic pulse is generated at least once before or after the basic pulse.

According to an aspect of the present invention, an image forming method is used in an inkjet head including a pressure chamber filled with ink, a nozzle which communicates with the pressure chamber and in which a meniscus of the ink is formed, a piezoelectric element which pressurizes the pressure chamber, and a drive circuit which performs an operation of ejecting the ink in a printing state and generates a basic pulse for vibrating the meniscus in a non-printing state, the basic pulse being generated by turning off a voltage applied to the piezoelectric element for substantially the same period as a natural vibration period of the ink. The image forming method includes the step of generating an additional pulse at least once before or after the basic pulse when the basic pulse is generated by the drive circuit in the non-printing state, the additional pulse being generated by turning off the voltage applied to the piezoelectric element.

Thus, an image forming method capable of vibrating the meniscus without causing the ink droplet from being ejected from the nozzle is provided.

DETAILED DESCRIPTION OF EMBODIMENTS OF THE INVENTION

Embodiments of the present invention will be described below with reference to the drawings.

Figure 1:
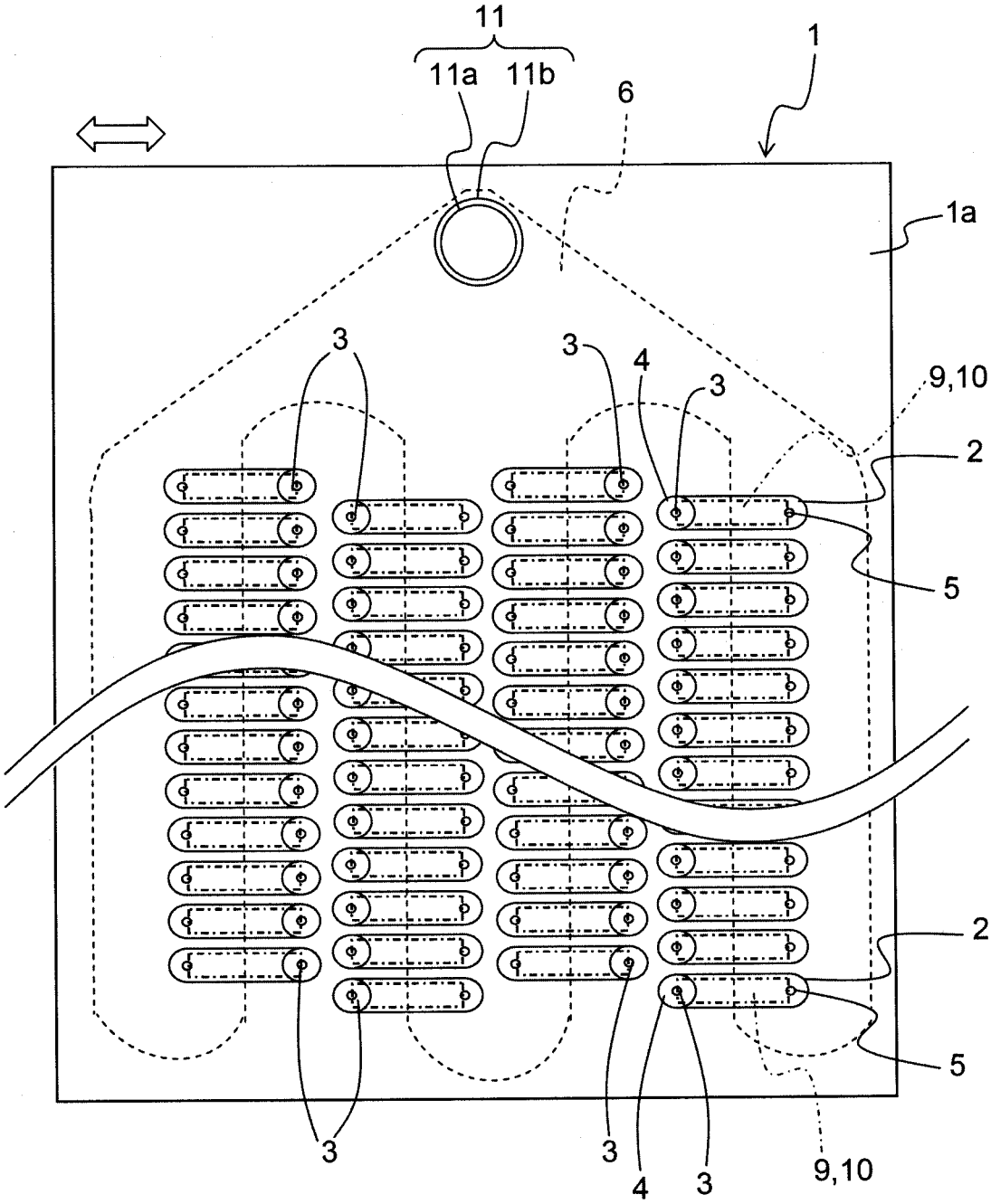
FIG. 1 is a plan view of an inkjet head in the state in which a driving unit including piezoelectric elements and a vibrating plate according to the present invention is not yet attached.
Figure 13:
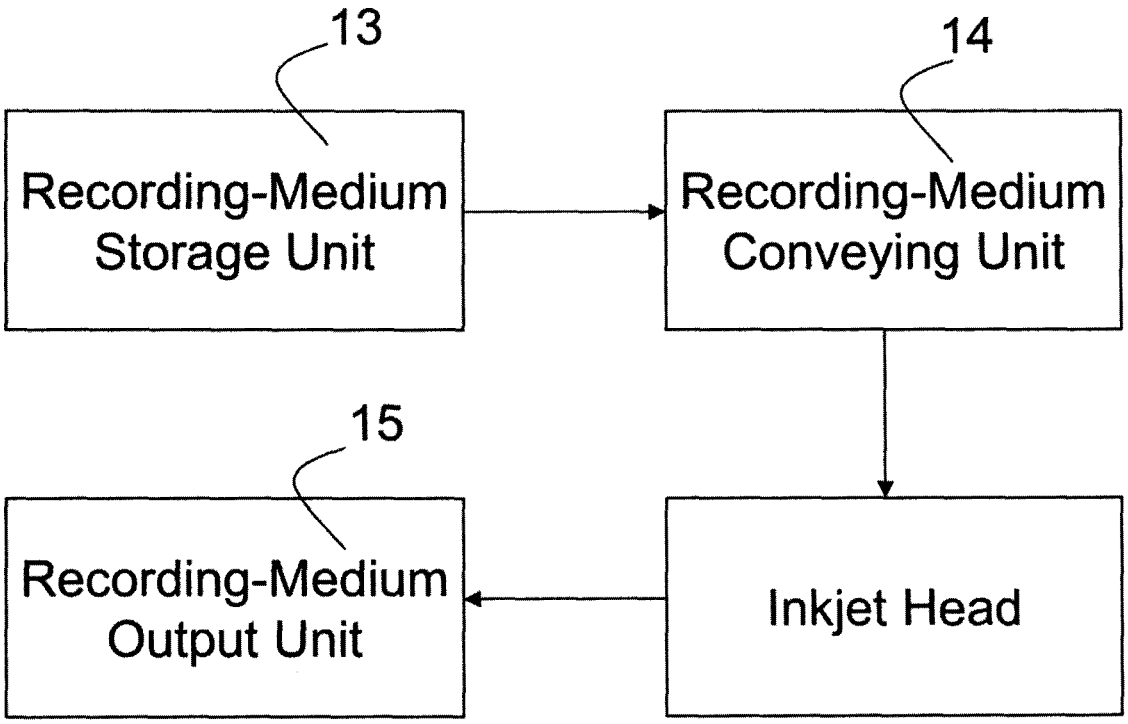
FIG. 13 is a block diagram illustrating components of an image forming apparatus according to the present invention.

FIG. 1 shows a plan view of an example of an inkjet head according to an embodiment of the present invention in the state in which a driving unit including piezoelectric elements and a vibrating plate is not yet attached. In the example of the inkjet head shown in FIG. 1, a plurality of printing units, each of which includes a pressure chamber 2 and a nozzle 3 which communicates with the pressure chamber 2, are arranged on a single substrate 1. The nozzles 3 in the printing units are arranged along a plurality of columns. The columns of nozzles 3 are arranged in a main scanning direction, which is shown by the white arrow in FIG. 1. In the example shown in FIG. 1, the nozzles 3 are arranged in four columns, and the pitch between the printing units in each column is 90 dpi (dot per inch). Therefore, the pitch of the inkjet head is 360 dpi. The inkjet head according to the present embodiment is a line-type inkjet head, and is fixed in an inkjet recording apparatus. The inkjet recording apparatus is an example of an image forming apparatus. Referring to FIG. 13, the inkjet recording apparatus mainly includes a recording-medium storage unit 13 which stores recording media on which an image is to be formed, a recording-medium conveying unit 14 which conveys a recording medium fed from the recording-medium storage unit 13 such that the recording medium passes through a position directly below the inkjet head, and a recording-medium output unit 15 which stores the recording medium after an image is formed thereon. When the recording medium being conveyed by the recording-medium conveying unit 14 passes through the position just below the inkjet head, ink droplets are ejected toward the recording medium. Accordingly, the image is formed on the recording medium.

Figure 2:
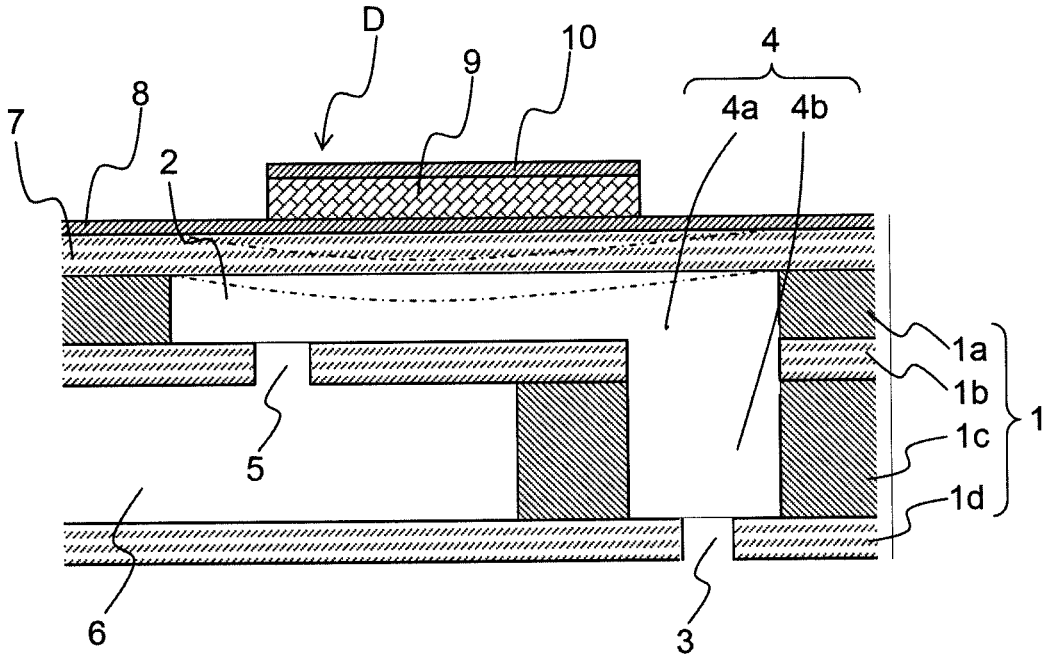
FIG. 2 is a sectional view of a single printing unit according to the present invention.
Figure 3:
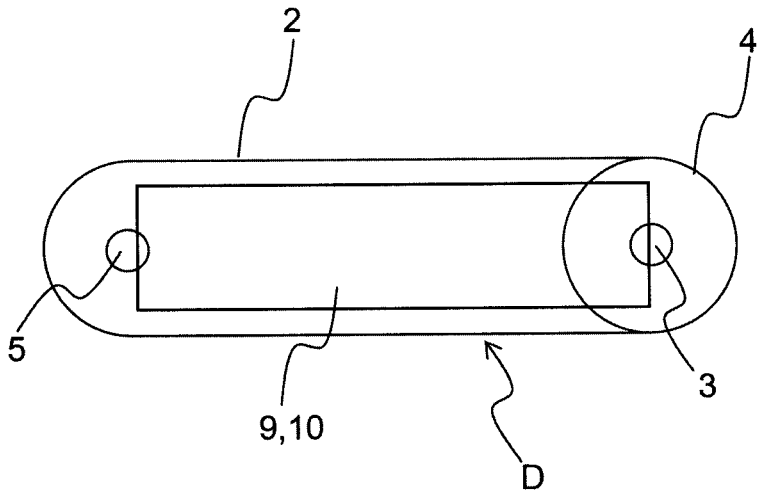
FIG. 3 is a perspective view illustrating the manner in which components overlap one another in each printing unit according to the present invention.

FIG. 2 is an enlarged sectional view of a single printing unit in the state in which the driving unit D is attached to the above-described inkjet head. FIG. 3 is a perspective view illustrating the manner in which components overlap one another in each printing unit.

Each printing unit mainly includes a pressure chamber 2, a nozzle 3, and an ink channel 4. The pressure chamber 2 is formed at an upper side of the substrate 1 in FIG. 2 and is shaped such that semicircular end sections are connected to the both ends of a rectangular central section in a plan view (see FIG. 3). The nozzle 3 is provided at a lower side of the substrate 1 and is positioned at the center of the semicircular section at a first end of the pressure chamber 2. The ink channel 4 has a circular shape in cross section, and the diameter of the ink channel 4 is equal to that of the semicircular sections of the pressure chamber 2 at either end thereof. The pressure chamber 2 and the nozzle 3 are connected to each other by the ink channel 4. A supply hole 5 is formed at the center of the semicircular section at a second end of the pressure chamber 2. The pressure chamber 2 is connected to a common supply channel 6 (shown by the dashed line in FIG. 1) through the supply hole 5. The common supply channel 6 is formed in the substrate 1 so as to connect the printing units to each other.

Referring to FIG. 2, in each printing unit, a first substrate la in which the pressure chamber 2 is formed, a second substrate 1*b* in which an upper section 4*a* of the ink channel 4 and the supply hole 5 are formed, a third substrate 1*c* in which a lower section 4*b* of the ink channel 4 and the common supply channel 6 are formed, and a fourth substrate 1*d* in which the nozzle 3 is formed are laminated in that order. In addition, as shown in FIG. 1, a through hole 11*a* which forms a joint 11 is formed in each of the first substrate 1*a* and the second substrate 1*b*. The joint 11 connects the common supply channel 6 formed in the third substrate 1*c* to a pipe of an ink cartridge (not shown) at the upper side of the substrate 1. The substrates 1*a* to 1*d* are made of resin, metal, etc., and through holes which define the above-mentioned elements are formed by, for example, an etching process using photolithography. The substrates 1*a* to 1*d* are formed as plates having predetermined thicknesses.

A single vibrating plate 7 having the same size as the size of the substrate 1 is laminated on the top surface of the substrate 1. A single thin film-shaped common electrode 8 having the same size as the size of the vibrating plate 7 is laminated on the top surface of the vibrating plate 7 so as to cover at least all printing units on the substrate 1. In addition, as shown by the dot-dash lines in FIG. 1, thin plate-shaped piezoelectric elements 9 and individual electrodes 10 are laminated on the common electrode 8 in that order at positions corresponding to the central sections of the pressure chambers 2 in the respective printing units. The piezoelectric elements 9 have a substantially rectangular shape in a plan view and vibrate in a transverse vibration mode. The individual electrodes 10 have the same shape as the shape of the piezoelectric elements 9 in a plan view, and are formed on the respective piezoelectric elements 9. Thus, the driving unit D has the piezoelectric elements 9 and the individual electrodes 10.

The piezoelectric elements 9 may also be formed such that each piezoelectric element 9 extends over the pressure chambers 2 in a plurality of printing units. In such a case, only the individual electrodes 10 are formed individually at the central sections of the pressure chambers 2 in the respective printing units as shown by the dot-dash lines in FIG. 1.

The vibrating plate 7 is made of an elemental metal, such as molybdenum, tungsten, tantalum, titanium, platinum, iron, and nickel, an alloy thereof, or a metal material such as stainless steel, and is formed in a plate shape with a predetermined thickness. A through hole 11*b*, which forms the joint 11 together with the through hole 11*a* in the substrate 1, is formed in the vibrating plate 7. The common electrode 8 and the individual electrodes 10 are formed of a metal foil made of a highly conductive metal, such as gold, silver, platinum, copper, and aluminum, or a film of such a metal formed by plating or vacuum evaporation. The common electrode 8 may also be omitted if the vibrating plate 7 is formed of a highly conductive metal, such as platinum.

The piezoelectric elements 9 are made of a piezoelectric material such as lead zirconate titanate (PZT) or a PZT-based piezoelectric material like PLZT which is obtained by adding one or two kinds of oxides of lanthanum, barium, niobium, zinc, nickel, manganese, etc., to PZT. In addition, materials including lead magnesium niobate (PMN), lead nickel niobate (PNN), lead zinc niobate, lead manganese niobate, lead antimony stannate, lead titanate, barium titanate, etc., as the main component may also be used as the piezoelectric material.

The thin plate-shaped piezoelectric elements 9 may be formed by a common method. For example, thin plate-shaped chips having a certain shape in a plan view may be formed by grinding sintered bodies of piezoelectric material, and the thus-obtained chips may be fixed to the common electrode 8 at predetermined positions by adhesion. Alternatively, the piezoelectric elements 9 may also be formed by forming thin films of piezoelectric material having a certain shape in a plan view on the common electrode 8 by a vapor growth method, such as a reactive sputtering method, a reactive vacuum evaporation method, or a reactive ion plating method.

To vibrate the piezoelectric elements 9 in the transverse vibration mode, the polarization direction of the piezoelectric material is set to the thickness direction of the piezoelectric elements 9, more specifically, to the direction from the individual electrodes 10 toward the common electrode 8. For this purpose, a common polarization method, such as a high-temperature polarization method, a room-temperature polarization method, a polarization method by applying an alternating electric field overlapped with a direct electric field, an electric field cooling method, etc., may be used. Alternatively, the piezoelectric elements 9 may first be polarized, and then be subjected to an aging process.

Thus, the piezoelectric material of each piezoelectric element 9 is polarized in the above-described direction. When the common electrode 8 is grounded and a positive drive voltage Vp is applied to each piezoelectric element 9 through the corresponding individual electrode 10, the piezoelectric element 9 contracts in a planar direction that is perpendicular to the polarization direction. Since the piezoelectric element 9 is fixed to the vibrating plate 7 with the common electrode 8 disposed therebetween, the piezoelectric element 9 and the vibrating plate 7 bend toward the pressure chamber 2, as shown by the dot-dash lines in FIG. 2.

Thus, the force generated by the bending of the piezoelectric element 9 and the vibrating plate 7 is transmitted to the ink in the pressure chamber 2 as a change in the pressure. The change in the pressure causes the ink in the supply hole 5, the pressure chamber 2, the ink channel 4, and the nozzle 3 to vibrate. As a result, the pressure wave moves toward the end of the nozzle 3, and thereby the ink meniscus in the nozzle 3 is pushed outward from the end of the nozzle 3. Thus, the above-described ink column projects outward from the end of the nozzle 3. Then, when the direction of the pressure wave of the ink changes to the direction toward the pressure chamber 2, the ink column in the projecting state is separated from the ink in the nozzle 3 and is ejected toward a sheet of paper as an ink droplet. Thus, a dot is formed on the sheet of paper.

An amount of ink corresponding to the amount of ink ejected as an ink droplet is supplied to the nozzle 3 due to the surface tension of the meniscus in the nozzle 3. The ink is supplied to the nozzle 3 from the ink cartridge through the pipe of the ink cartridge, the joint 11, the common supply channel 6, the supply hole 5, the pressure chamber 2, and the ink channel 4.

Figure 4:
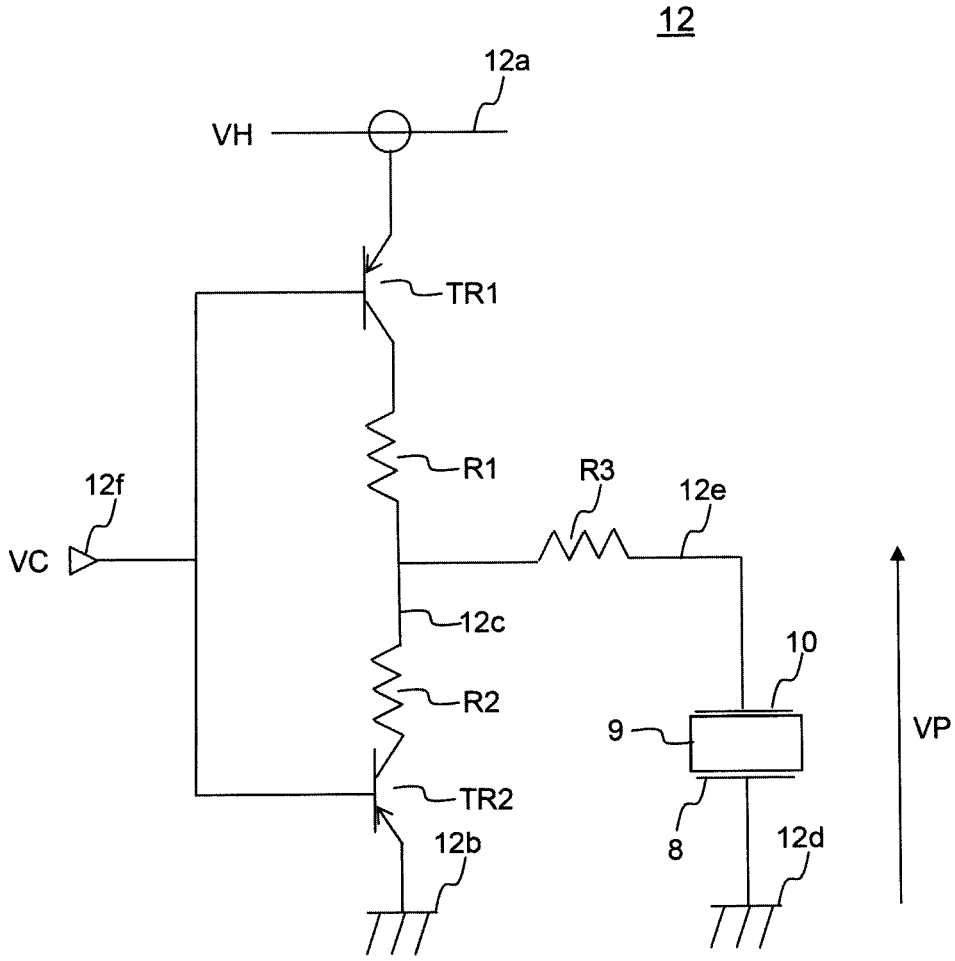
FIG. 4 is a circuit diagram illustrating an example of a driving circuit according to the present invention.

In the present embodiment, the drive voltage wave to be applied to each piezoelectric element 9 through the corresponding individual electrode 10 is generated by a drive circuit 12 shown in FIG. 4. The drive circuit 12 includes a first circuit section 12*c* formed by connecting a first transistor TR1, resistors R1 and R2, and a second transistor TR2 in series between a power wire 12*a* and a ground 12*b*. The drive circuit 12 also includes a second circuit section 12*e* which connects a point between the resistors R1 and R2 of the first circuit section 12*c* to a ground 12*d* through a resistor R3, the individual electrode 10, the piezoelectric element 9, and the common electrode 8. A terminal 12*f* for applying a control voltage VC is connected to bases of the transistors TR1 and TR2. The piezoelectric element 9 has a function equivalent to that of a capacitor.

The same number of drive circuits 12 as the number of piezoelectric elements 9 are formed on, for example, an integrated circuit so that the piezoelectric elements 9 in the printing units of the piezoelectric inkjet head can be driven individually. The second circuit sections 12*e* of the drive circuits 12 are individually connected to the individual electrodes 10 laminated on the respective piezoelectric elements 9. In addition, the terminals 12*f* of the drive circuits 12 are individually connected to a control circuit (not shown) so that the control voltage corresponding to the data of an image to be formed can be individually applied to the drive circuits 12 through the terminals 12*f* and each drive circuit 12 can be driven individually.

Figure 9:
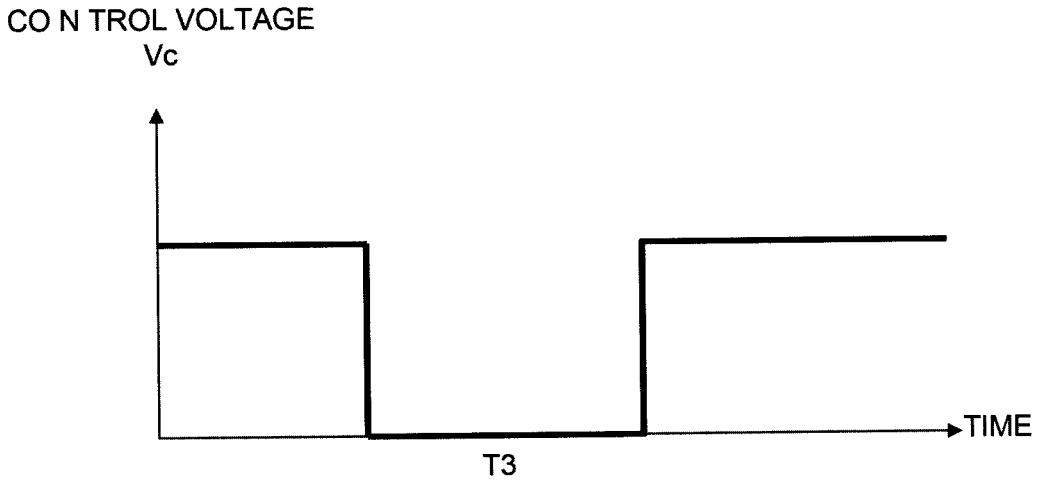
FIG. 9 is a graph illustrating the waveform of a basic pulse voltage according to the present invention.
Figure 10:
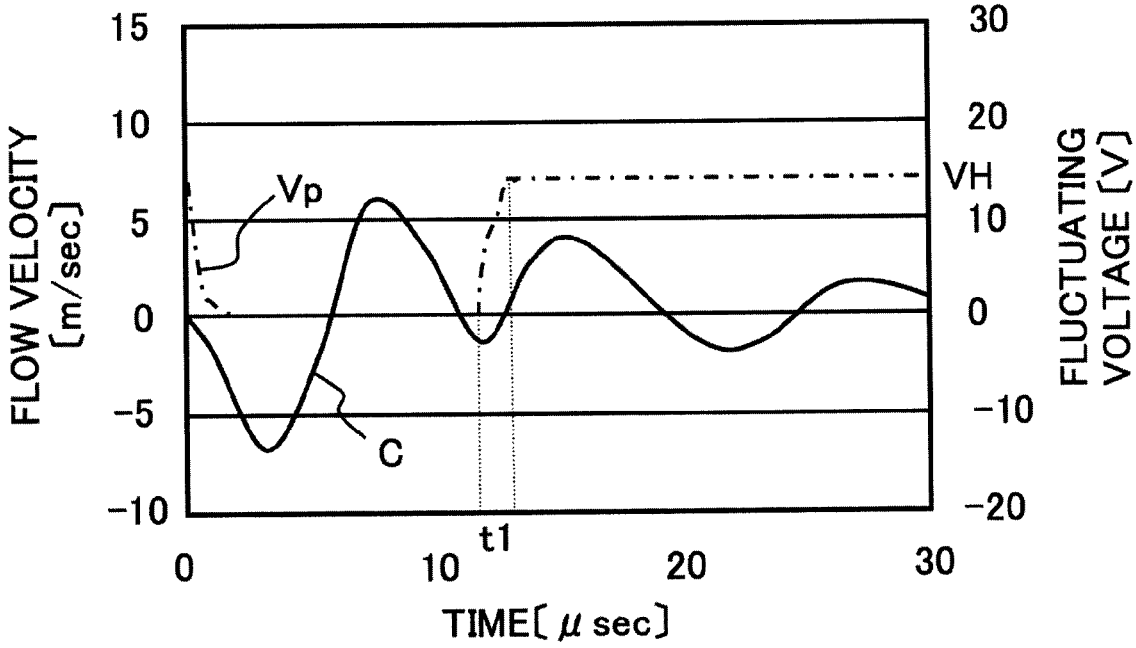
FIG. 10 is a graph of the fluctuating voltage and the volume velocity of the ink according to the related art.

In a non-printing state (the meaning of non-printing state will be described below), a basic pulse shown in FIG. 9 is generated as the control voltage Vc. Accordingly, a fluctuating voltage Vp for vibrating the meniscus is generated in the second circuit section 12*e* as shown by the dot-dash lines in FIG. 10. The waveform of the basic pulse wave is such that the voltage applied to the piezoelectric element 9 is turned off for a pulse width corresponding to a period T3 that is substantially equal to the natural vibration period of the ink. As a result, the ink in the nozzle 3 vibrates as shown by the solid line C in FIG. 10. As described above, the pulse width T3 is substantially equal to the natural vibration period T1 of the ink, and is set to about 15 μs. Under these conditions, the meniscus vibrates without causing the ink to be ejected from the nozzle 3. In the present embodiment, the control voltage Vc is about 5 V, and the basic pulse voltage Vp is about 13 V.

Figure 11:
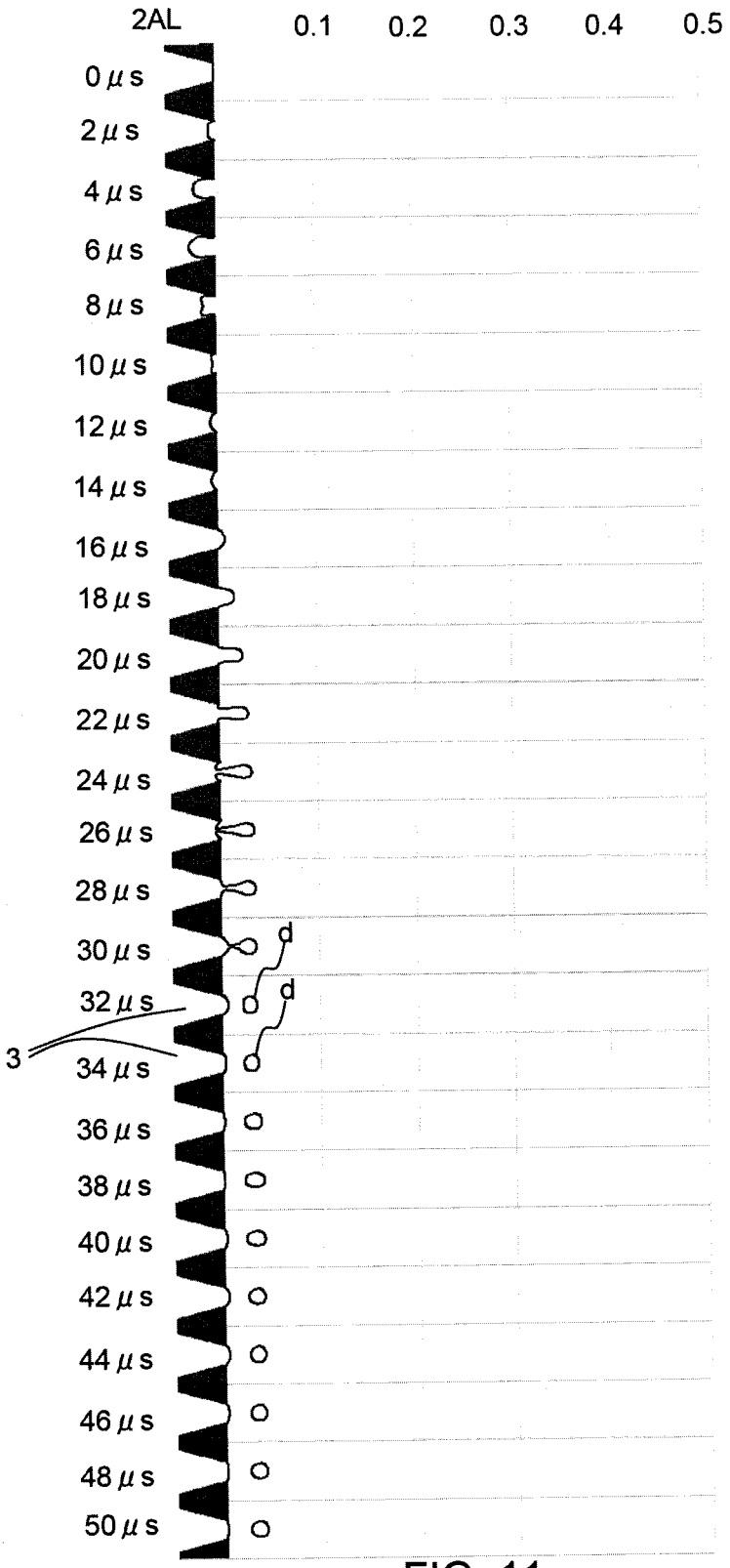
FIG. 11 is a simulation diagram regarding the vibration of the meniscus according to the related art.
Figure 12:
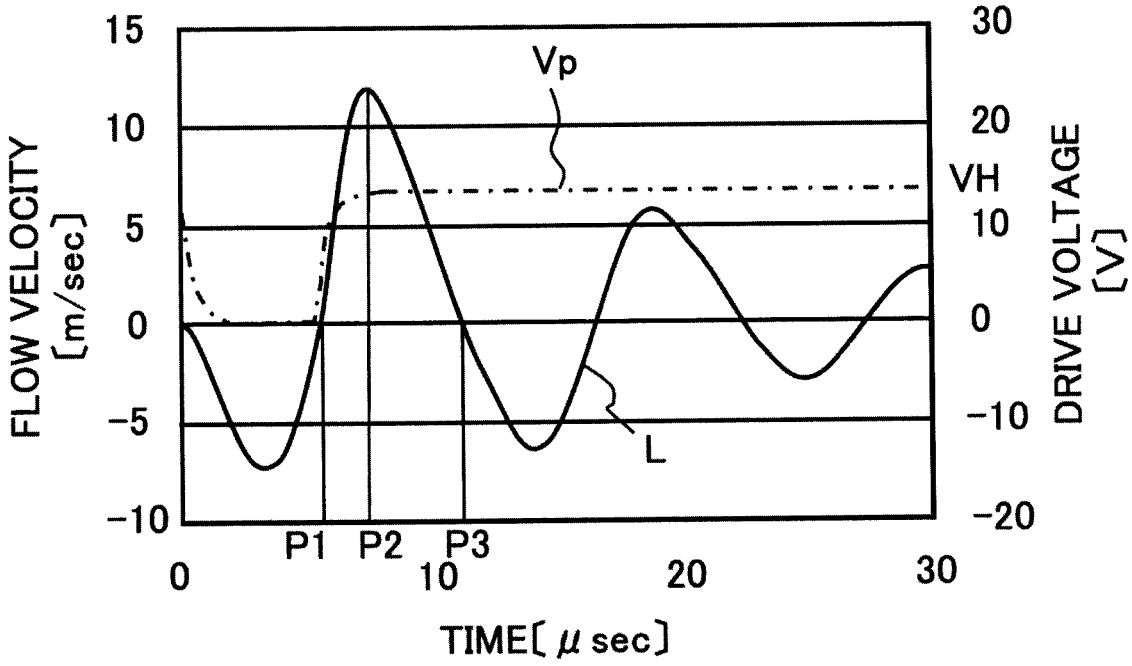
FIG. 12 is a graph of the drive voltage and the volume velocity of the ink according to the related art.

It has been found through experiments, however, that even when the above-mentioned basic pulse is used in the non-printing state, there is a slight possibility that the ink droplet will be ejected from the nozzle 3 depending on the conditions, such as viscosity of the ink and room temperature. FIG. 11 shows the result of a computer simulation carried out to determine whether or not an ink droplet will be ejected. In FIG. 11, the vertical axis shows the time (in unit of μs) and the horizontal axis shows the distance (in unit of mm) from the end of the nozzle 3. In the computer simulation, the ink viscosity is set to 3 mPas to 5 mPas. This viscosity is a standard viscosity of ink used in inkjet printing. According to the method of the related art as shown in the FIG. 11, there is a possibility that an ink droplet d will be ejected from the nozzle 3. Unless this problem is solved, there is a risk that the ink will be ejected in the non-printing state and the inside of the image forming apparatus will be stained. In addition, there is also a risk that the ink will be ejected toward a non-printing area of the sheet and the image quality will be degraded.

The inventors of the present invention have found through the computer simulation that the meniscus can be vibrated without causing an ink droplet to be ejected from the nozzle 3 if an additional pulse voltage having substantially the same period as a rising period t1 (see FIG. 10) of the fluctuating voltage based on the basic pulse is generated at least once before or after the basic pulse.

Figure 5:
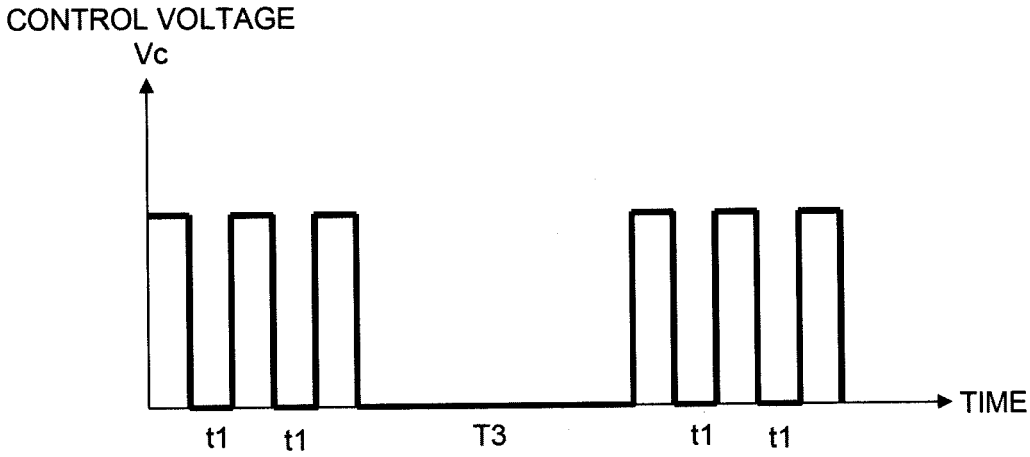
FIG. 5 is a graph illustrating the waveform of an additional pulse voltage according to the present invention.
Figure 6:
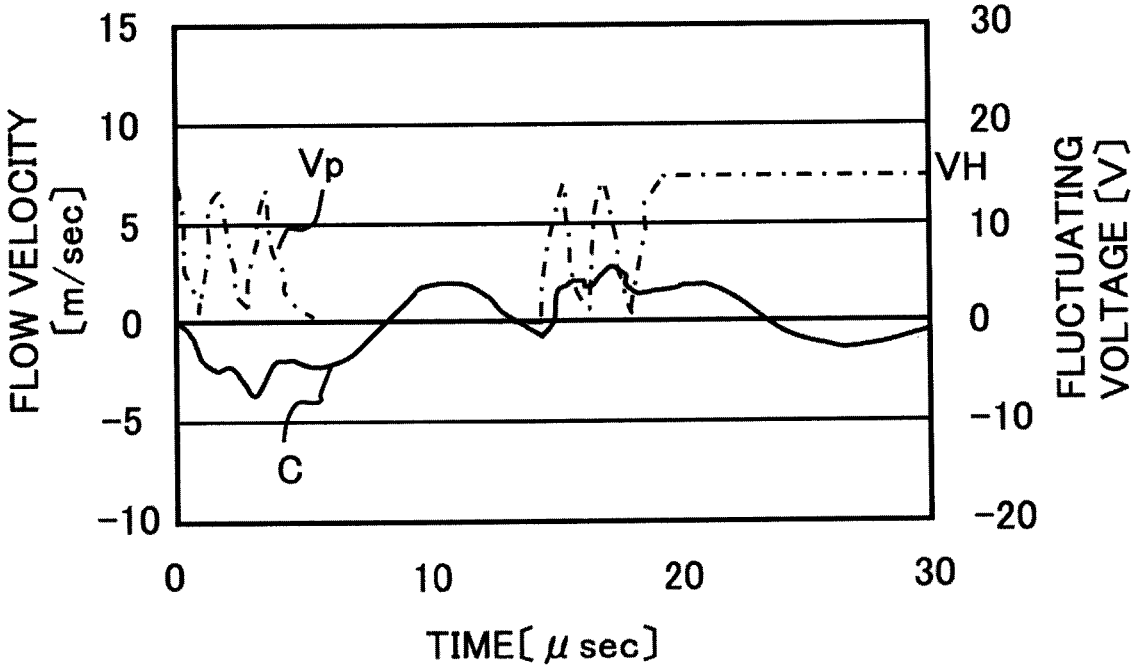
FIG. 6 is a graph of the fluctuating voltage and the volume velocity of the ink according to the present invention.
Figure 7:
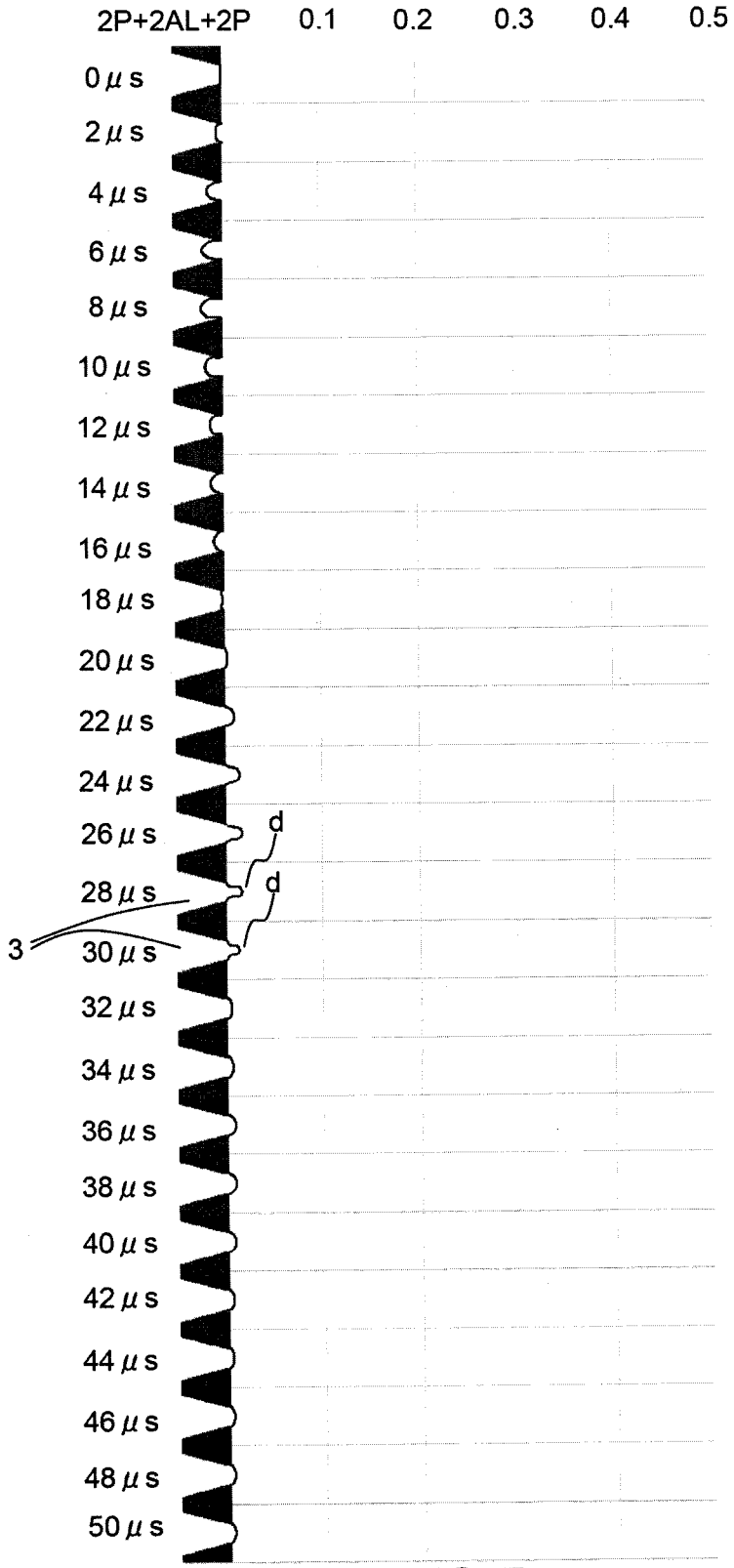
FIG. 7 is a simulation diagram regarding the vibration of the meniscus according to the present invention.

More specifically, as shown in FIG. 5, the control voltage Vc is formed by adding an additional pulse with a pulse width t1 twice before and after the basic pulse with the pulse width T3. The waveform of the additional pulse is such that the voltage applied to the piezoelectric element 9 is turned off for the pulse width t1. Accordingly, the curve Vp shown by the dot-dash line in FIG. 6 is obtained as the fluctuating voltage Vp, and the meniscus vibrates as shown by the solid curve C in FIG. 6. Similar to FIG. 11, FIG. 7 shows the result of a computer simulation carried out to determine whether or not an ink droplet will be ejected under the above-mentioned conditions. Also in FIG. 7, the vertical axis shows the time (in unit of μs) and the horizontal axis shows the distance (in unit of mm) from the end of the nozzle 3. Also in this computer simulation, the ink viscosity is set to 3 mPas to 5 mPas, which is a standard viscosity of ink used in inkjet printing. In addition, the additional pulse voltage is set to be equal to the basic pulse voltage, that is, to about 13 V.

As is clear from FIG. 7, according to the present invention, the meniscus can be vibrated without causing the ink droplet to be ejected from the nozzle 3. The addition of the additional pulse before and after the basic pulse is basically equivalent to slowing the rising and falling edges of the fluctuating voltage Vp based on the basic pulse voltage. As a result, the meniscus is gently vibrated and the ink droplet is prevented from being ejected from the nozzle 3.

The pulse width t1 of the additional pulse is substantially equal to the rising period of the fluctuating voltage Vp generated when the basic pulse is applied to the piezoelectric element 9. The pulse width t1 is determined by the resistances of the resistors R1 and R3 and the capacitance C of the piezoelectric element 9 in the circuit structure shown in FIG. 4, and is calculated as $t1 \approx C(R1+R3)\ln 9$. In the present embodiment, t1 is about 1.5 μs. In addition, the intervals between the additional pulses and the intervals between the bas is pulse and the additional pulses are also set to t1, which is about 1.5 μs.

As described above, according to the present invention, the meniscus can be vibrated without causing the ink droplet to be ejected simply by applying an additional pulse before and after the basic pulse, and no additional hardware is required. FIGS. 5 to 7 show the case in which the additional pulse voltage is applied twice before and after the basic pulse. This is simply an example, however, and it has been confirmed through experiments using an experimental apparatus that the effects of the present invention can be obtained if the additional pulse is applied at least once before or after the basic pulse. In the present embodiment, the additional pulse is applied twice before and after the basic pulse in consideration of differences in ink characteristics, variation with time of the ink characteristics, and differences in characteristics of the piezoelectric elements. The effects of the present invention can, of course, also be obtained when the additional pulse is applied three or more times before and after the basic pulse. It is preferable, however, to avoid adding the additional pulse more than necessary because if the additional pulse is applied three or more times before and after the basic pulse, it takes a long time for the vibrated meniscus to stabilize (to stop). Therefore, if the next printing cycle starts before the meniscus becomes stationary, there is a risk that the velocity of the ink droplet to be ejected will vary. As a result, there is a risk that the position where the ink droplet lands on the sheet of paper or the size of the ink droplet will vary and the print quality will be degraded.

Lastly, the term "non-printing state" used in the foregoing description will be explained. As is clear from the foregoing description, the meniscus is vibrated in the non-printing state. Primarily, the non-printing state corresponds to the period from when a certain printing job is completed to when the next printing job is started. In the present invention, however, the non-printing state has a more detailed meaning.

Figure 8:
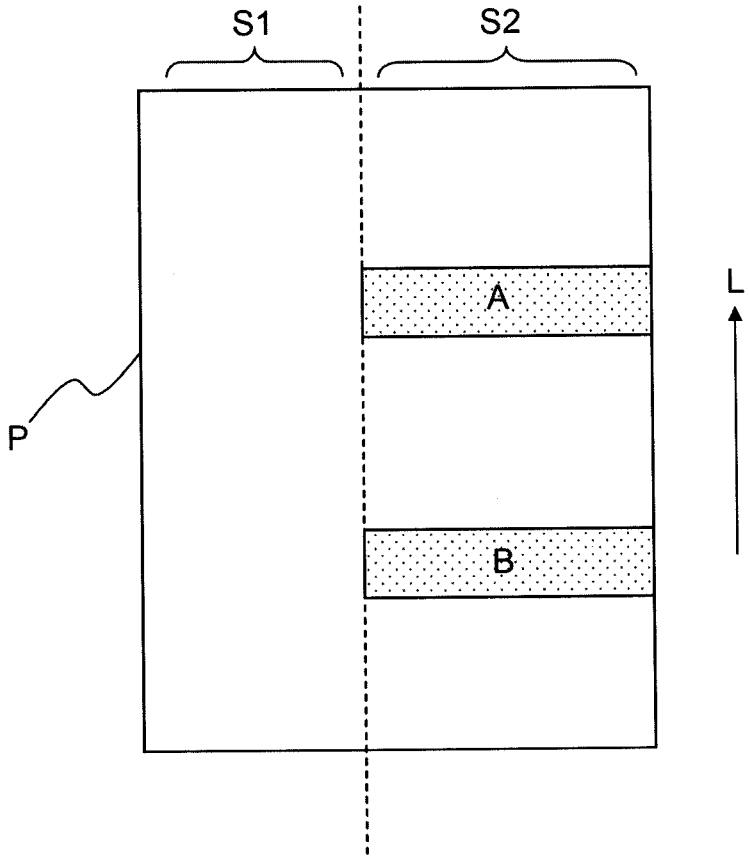
FIG. 8 is a diagram illustrating a non-printing state according to the present invention.

For example, referring to FIG. 8, in the case where a sheet of paper P is conveyed in the direction shown by the arrow L during printing of an image on the sheet of paper P, it is determined that nozzles 3 corresponding to an area S1 with no image data are in the non-printing state and the process of vibrating the meniscus is performed. In addition, in an area S2 having image data A and B, if an interval between the image data A and B is equal to or larger than a predetermined time interval (500 pixels in the present embodiment), it is determined that nozzles 3 are in the non-printing state. Accordingly, the meniscus is vibrated in the nozzles 3 in a period from when the printing operation for the image data A is ended to when the printing operation for the image data B is started. Thus, when printing an image on a recording medium, such as a sheet of paper, it is determined that the nozzles 3 are in the non-printing state when the nozzles 3 are not caused to eject the ink droplets for a predetermined time period or more.

Thus, according to the present embodiment, the determination of whether or not the non-printing state is performed for each pixel (each nozzle 3). And the vibration of the meniscus is extremely finely controlled. Therefore, the ink in each nozzle 3 is prevented from solidifying, and smooth, high-quality images can always be printed. The above-mentioned interval of 500 pixels is determined on the basis of the time period from when the meniscus is vibrated to when the meniscus becomes stationary, which is about 2.5 ms. The interval of 500 pixels is, of course, also simply an example and can be adequately determined in accordance with the printing speed and etc.

What is claimed is:

1. An image forming method for use in an inkjet head including a pressure chamber filled with ink, a nozzle which communicates with the pressure chamber and in which a meniscus of the ink is formed, a piezoelectric element which pressurizes the pressure chamber, and a drive circuit which performs an operation of ejecting the ink in a printing state and generates a basic pulse for vibrating the meniscus in a non-printing state, the basic pulse being generated by turning off a voltage applied to the piezoelectric element for substantially the same period as a natural vibration period of the ink, the image forming method comprising the step of:

generating an additional pulse at least once before or after the basic pulse when the basic pulse is generated by the drive circuit in the non-printing state, the additional pulse being generated by turning off the voltage applied to the piezoelectric element, wherein an interval between the basic pulse and the additional pulse is substantially equal to a rising period of a fluctuating voltage generated by the basic pulse.

2. The image forming method according to claim 1, wherein the additional pulse has a pulse width corresponding to a period that is substantially equal to a rising period of a fluctuating voltage generated by the basic pulse.

3. The image forming method according to claim 1, wherein, when the additional pulse is generated two or more times before or after the basic pulse, an interval between the generated additional pulses is substantially equal to a rising period of a fluctuating voltage generated by the basic pulse.

4. The image forming method according to claim 1, wherein the inkjet head is a line-type inkjet head.

5. The image forming method according to claim 1, wherein the non-printing state is the state in which no image data is provided for at least a predetermined time interval.

6. An image forming apparatus, comprising:

an inkjet head including a pressure chamber filled with ink, a nozzle which communicates with the pressure chamber and in which a meniscus of the ink is formed, a piezoelectric element which pressurizes the pressure chamber, and a drive circuit which performs an operation of ejecting the ink in a printing state and generates a basic pulse for vibrating the meniscus in a non-printing state, the basic pulse being generated by turning off a voltage applied to the piezoelectric element for substantially the same period as a natural vibration period of the ink;

a recording-medium storage unit configured to store a recording medium;

a recording-medium conveying unit configured to convey the recording medium; and a recording-medium output unit configured to store the recording medium after an image is formed on the recording medium, wherein an additional pulse is generated at least once before or after the basic pulse when the basic pulse is generated by the drive circuit in the non-printing state, the additional pulse being generated by turning off the voltage applied to the piezoelectric element, wherein an interval between the basic pulse and the additional pulse is substantially equal to a rising period of a fluctuating voltage generated by the basic pulse.

7. The image forming apparatus according to claim 6, wherein the additional pulse has a pulse width corresponding to a period that is substantially equal to a rising period of a fluctuating voltage generated by the basic pulse.

8. The image forming apparatus according to claim 6, wherein, when the additional pulse is generated two or more times before or after the basic pulse, an interval between the generated additional pulses is substantially equal to a rising period of a fluctuating voltage generated by the basic pulse.

9. The image forming apparatus according to claim 6, wherein the inkjet head is a line-type inkjet head.

10. The image forming apparatus according to claim 6, wherein the non-printing state is the state in which no image data is provided for at least a predetermined time interval.

11. An inkjet head, comprising:

a pressure chamber filled with ink;

a nozzle which communicates with the pressure chamber and in which a meniscus of the ink is formed;

a piezoelectric element which pressurizes the pressure chamber; and a drive circuit configured to generate a basic pulse for vibrating the meniscus in a non-printing state, the basic pulse being generated by turning off a voltage applied to the piezoelectric element for substantially the same period as a natural vibration period of the ink;

wherein the drive circuit is further configured to generate an additional pulse at least once before or after the basic pulse in the non-printing state, the additional pulse being generated by turning off the voltage applied to the piezoelectric element, wherein an interval between the basic pulse and the additional pulse is substantially equal to a rising period of a fluctuating voltage generated by the basic pulse.

12. The inkjet head according to claim 11, wherein the additional pulse has a pulse width corresponding to a period that is substantially equal to a rising period of a fluctuating voltage generated by the basic pulse.

13. The inkjet head according to claim 11, wherein, when the additional pulse is generated two or more times before or after the basic pulse, an interval between the generated additional pulses is substantially equal to a rising period of a fluctuating voltage generated by the basic pulse.

14. The inkjet head according to claim 11, wherein the inkjet head is a line-type inkjet head.

15. The inkjet head according to claim 11, wherein the non-printing state is the state in which no image data is provided for at least a predetermined time interval.

* * * * *